US008376759B2

(12) United States Patent
Debock et al.

(10) Patent No.: US 8,376,759 B2
(45) Date of Patent: Feb. 19, 2013

(54) CONNECTORS FOR E-TEXTILES

(75) Inventors: Kimberly Ann Debock, Hummelstown, PA (US); David James Fabian, Mount Joy, PA (US); James Scott Showers, Stewartstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/236,380

(22) Filed: Sep. 19, 2011

(65) Prior Publication Data

US 2012/0071015 A1 Mar. 22, 2012

Related U.S. Application Data

(60) Provisional application No. 61/384,593, filed on Sep. 20, 2010.

(51) Int. Cl.
*H01R 33/00* (2006.01)

(52) U.S. Cl. ..... 439/37

(58) Field of Classification Search ..... 439/37, 439/521, 752, 877, 495, 607.01
See application file for complete search history.

(56) References Cited

U.S. PATENT DOCUMENTS

| | | | | |
|---|---|---|---|---|
| 6,319,015 | B1 * | 11/2001 | Faunce | 439/37 |
| 6,561,814 | B2 | 5/2003 | Tilbury et al. | |
| 6,767,218 | B2 * | 7/2004 | Marmaropoulos | 439/37 |
| 6,863,539 | B2 * | 3/2005 | Marmaropoulos | 439/37 |
| 6,869,306 | B1 | 3/2005 | Sung | |
| 7,025,596 | B2 * | 4/2006 | Zollo et al. | 439/37 |
| 7,179,140 | B2 * | 2/2007 | Jung et al. | 439/877 |
| 7,210,939 | B2 | 5/2007 | Marmaropoulos et al. | |
| 7,365,031 | B2 | 4/2008 | Swallow et al. | |
| 7,462,035 | B2 | 12/2008 | Lee et al. | |
| 7,556,532 | B2 | 7/2009 | Lee et al. | |
| 7,658,612 | B2 | 2/2010 | Lee et al. | |
| 7,731,517 | B2 | 6/2010 | Lee et al. | |
| 7,753,685 | B2 | 7/2010 | Lee et al. | |
| 2004/0244193 | A1 * | 12/2004 | Jung et al. | 29/854 |
| 2004/0259391 | A1 * | 12/2004 | Jung et al. | 439/37 |
| 2006/0099849 | A1 | 5/2006 | Aeschbacher | |
| 2006/0124193 | A1 | 6/2006 | Orr et al. | |
| 2010/0048066 | A1 | 2/2010 | Bertsch et al. | |
| 2010/0100997 | A1 | 4/2010 | Lee et al. | |

FOREIGN PATENT DOCUMENTS

| | | | |
|---|---|---|---|
| CN | 201 440 535 | U | 4/2010 |
| DE | 10 2006 019269 | A1 | 10/2007 |
| EP | 0 573 126 | A2 | 12/1993 |
| EP | 0 641 043 | A2 | 3/1995 |
| EP | 2 107 642 | A2 | 10/2009 |
| GB | 2 050 208 | A | 1/1981 |
| WO | WO 2004/084353 | A1 | 9/2004 |

OTHER PUBLICATIONS

International Search Report, International Application No. PCT/US2011/001624, International Filing Date Sep. 20, 2011.

Annex to Form PCT/ISA/206 (Communication Relating to the Results of the Partial International Search), International Application No. PCT/US2011/001625, International Filing Date Sep. 20, 2011.

* cited by examiner

*Primary Examiner* — Chandrika Prasad

(57) ABSTRACT

A connector for an e-textile that has conductors that define a conductive layer of the e-textile includes a terminal subassembly that has terminals configured to be electrically connected to corresponding conductors of the e-textile. The terminal subassembly has an insulator holding the terminals. The terminals have mating interfaces. A shell holds the terminal subassembly. The shell has a front and a rear. The rear is configured to receive the e-textile. The shell has a bottom and a top. The top is open sided to provide access to the mating interfaces of the terminals for mating with a mating connector.

29 Claims, 5 Drawing Sheets

CONNECTORS FOR E-TEXTILES

CROSS REFERENCE TO RELATED APPLICATION

The present application relates to and claims priority from Provisional Application Ser. No. 61/384,593 filed Sep. 20, 2010, titled "INTERCONNECT OR TERMINATION METHODOLOGY FOR E-TEXTILES", the complete subject matter of which is hereby expressly incorporated by reference in its entirety.

The present application relates to US patent application 13/236,330 having , titled "INTERCONNECT AND TERMINATION METHODOLOGY FOR E-TEXTILES" and filed on the same day as the present application, the complete subject matter of which is hereby expressly incorporated by reference in its entirety.

BACKGROUND OF THE INVENTION

The subject matter herein relates generally to electronic textiles, and more particularly, to connectors for electronic textiles.

Electronic textiles (e-textiles) are known and used as wearable technology, such as intelligent clothing or smart clothing, that allow for the incorporation of built-in technological elements in textiles and/or clothes. E-textiles may be used in many different applications, including first responder (e.g. fire and police) worn electronics systems, maintenance technician worn electronics systems, soldier worn electronics systems and the like. E-textiles are typically fabrics that enable computing, digital components and electronics to be embedded in them. E-textiles typically have electronic devices, such as conducting wires, integrated circuits, LEDs, conventional batteries and the like, mounted into garments. Some e-textiles have electronic functions incorporated directly on the textile fibers.

Known e-textiles are not without disadvantages. For example, the wearable devices are typically connected by cables and circular connectors. The cables are typically exposed and can be snagged in the field. The circular connectors may cause irritation to the body due to their shape and/or size. Some known connectors use flat flexible circuits or insulated wires that are interwoven with a nylon material, however these circuits do not allow for high speed data. The circuits are not shielded to meet EMI/RFI demands in the field, causing excessive interference with the data signals. Another problem with known e-textile connectors, such as circular connectors, is that the circular connectors are not capable of being cleaned in the field. For example, the pin and socket or pad and spring probe contact interfaces are shrouded, which enables collection of debris, which can not be easily cleaned in the field. Attempts to clean such interfaces typically lead to damage of the pins or spring probes.

A need remains for an e-textile connector that meets high speed data requirements in terms of matched impedance and electrical shielding to meet EMI/RFI demands. A need remains for an e-textile connector that is capable of meeting harsh environment demands as well as being cleaned in the field.

BRIEF DESCRIPTION OF THE INVENTION

In one embodiment, a connector for an e-textile is provided that has conductors that define a conductive layer of the e-textile. The connector has a terminal subassembly that has terminals configured to be electrically connected to corresponding conductors of the e-textile. The terminal subassembly has an insulator holding the terminals. The terminals have mating interfaces. A shell holds the terminal subassembly. The shell has a front and a rear. The rear is configured to receive the e-textile. The shell has a bottom and a top. The top is open sided to provide access to the mating interfaces of the terminals for mating with a mating connector, such as to allow easy access or cleaning.

In another embodiment, a connector for an e-textile is provided that has conductors that define a conductive layer of the e-textile. The connector has a shell that defines a cavity that extends along a cavity axis between a front and a rear of the shell. The cavity is defined by a bottom wall. A top wall and side walls provide electrical shielding for the cavity. The top wall is shorter than the bottom wall such that the shell has an open top at the front of the shell. A terminal subassembly is received in the cavity. The terminal subassembly has a plurality of terminals held by an insulator. The terminals have mating ends and terminating ends. The insulator has a mating window proximate to a front of the terminal subassembly. The insulator has a terminating window proximate to a rear of the terminal subassembly. The terminals are exposed in the mating window and in the terminating window. The terminating ends of the terminals are configured to be electrically connected to corresponding conductors of the e-textile in the terminating window. The mating ends of the terminals are exposed in the mating window for mating with a mating connector.

In a further embodiment, a connector system for an e-textile having conductors that define a conductive layer of the e-textile. The connector has an e-textile connector configured to be terminated to the conductors of the e-textile and a mating connector mated to the e-textile connector. The e-textile connector comprises a terminal subassembly that has terminals configured to be electrically connected to corresponding conductors of the e-textile and an insulator holding the terminals. The e-textile connector further comprises a shell that holds the terminal subassembly. The shell has a front and a rear. The shell has a bottom and a top. The top is open sided to provide access to the terminals. The mating connector comprises a mating terminal subassembly that have mating terminals connected to corresponding terminals of the e-textile connector and a mating insulator that holds the mating terminals. The mating connector further comprises a mating shell that holds the mating terminal subassembly. The mating shell has a front and a rear. The mating shell has a bottom and a top that is open sided to provide access to the mating terminals. The mating connector is coupled to the e-textile connector with the open sided portions of the shell and mating shell that are aligned such that the terminals and mating terminals are electrically connected.

DETAILED DESCRIPTION OF THE INVENTION

Figure 1:
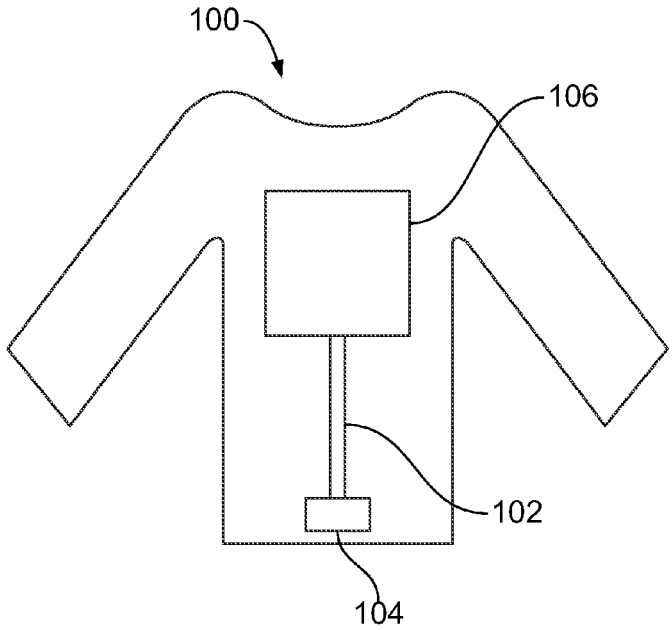
FIG. 1 illustrates a wearable article having an electronic textile therein.

FIG. 1 illustrates a wearable article 100, such as a garment, that incorporates an electronic textile (e-textile) 102 therein. The e-textile 102 includes fabrics that enable computing, digital components and/or electronics to be embedded therein. The e-textile 102 provides the wearable article 100 with wearable technology that allow for the incorporation of built-in technological elements into the fabric of the wearable article. The wearable article 100 may constitute intelligent clothing or smart clothing.

The e-textile 102 extends between a first electronic device 104 and a second electronic device 106. Any number of electronic devices may be utilized with the wearable article 100. In an exemplary embodiment, the first electronic device 104 constitutes a battery pack and the second electronic device 106 constitutes an LED array that may be powered by the battery pack. Other types of electronic devices may be incorporated into the wearable article 100 in alternative embodiments.

Figure 2:
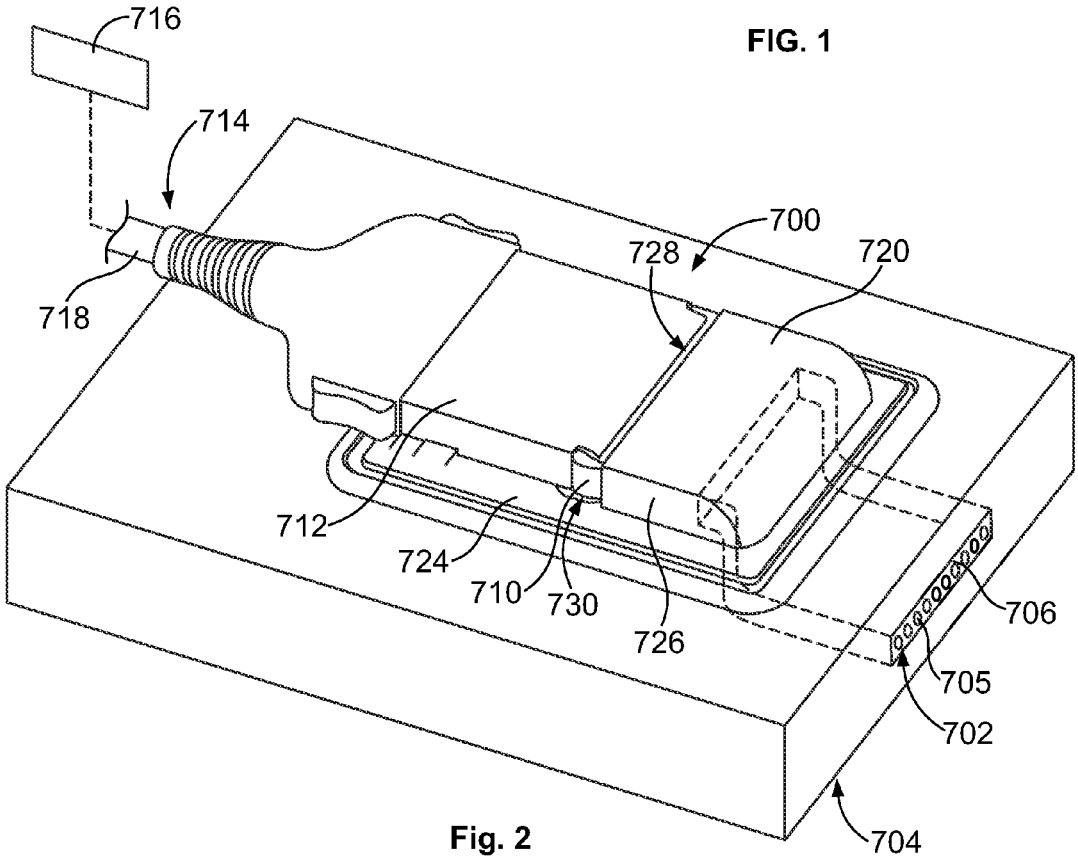
FIG. 2 is a perspective view of a connector system for the e-textile wearable article shown in FIG. 1 showing an e-textile connector and a mating connector.

FIG. 2 is a perspective view of a connector system 700 for the e-textile wearable article 100. The wearable article 100 has an e-textile layer 702 and a fabric layer 704 holding the e-textile layer 702. Optionally, the wearable article 100 may include only the e-textile layer 702 and not an outer fabric layer.

The e-textile layer 702 includes a conductive layer having a plurality of uninsulated conductors 705 woven into fabric or an insulator layer 706 of the e-textile layer. The uninsulated conductors 705 may include an outer conductive layer wrapped around polymer strands, yarns or fibers. The outer conductive layer defines a conductive area of the conductor 705.

The uninsulated conductors 705 are woven into non-conductive fibers such that the conductors 705 have a woven shape, where the conductors 705 weave between both opposing sides of the fabric. The fabric may have any number of layers, and the conductors 705 may be part of one or more of the layers. The layers may or may not be constructed as a weave, where a weft fiber and warp fiber are bi-directionally woven together. The conductors 705 are woven into the fabric such that portions of the conductors 705 are exposed for electrical connection to an e-textile connector 710. The connector system 700 is electrically connected to the conductors 705 of the e-textile layers 702.

In an exemplary embodiment, the connector system 700 is mounted to an exterior portion of the wearable article 100, such as on an outer surface of the fabric layer 704. Optionally, the connector system 700 may be provided in a pocket or other covering of the wearable article 100, while still being accessible from an exterior of the wearable article 100. For example, a flap may cover the connector system 700.

The connector system 700 includes an e-textile connector 710 and a mating connector 712 coupled to the e-textile connector 710. The e-textile connector 710 is terminated to the e-textile layer 702. In the illustrated embodiment, the mating connector 712 is part of a jumper assembly 714 that is electrically connected to an electronic device 716 via a cable 718. The cable 718 may have any length. Optionally, the length of the cable 718 may be relatively short with the e-textile connector 710 being positioned in close proximity to the electronic device 716. As such, the amount of cables on the outside of the wearable article 100 may be minimized. In an alternative embodiment, rather than using the jumper assembly 714 with the cable 718, the mating connector 712 may be mounted directly to the electronic device 716 and plugged into the e-textile connector 710.

The e-textile connector 710 is fixed in place on the wearable article 100 by a holder 720. The holder 720 may be secured to the wearable article 100, such as by being sewn to the wearable article 100 or by other industry methods. In the illustrated embodiment, the holder 720 has a groove extending along the perimeter of the holder 720 in which the thread of the stitches may be routed. The holder 720 includes a base 724 that extends along the outer or inner surface of the fabric layer 704. A shroud 726 extends from the base 724 and defines a chamber 728 that receives the e-textile connector 710. An opening 730 extends through the base 724 such that the e-textile connector 710 and the e-textile layer 702 may be passed through the fabric layer 704 and into the chamber 728 of the holder 720. The holder 720 has an open face to provide access to the e-textile connector 710 for the mating connector 712. For example, the area immediately adjacent the shroud 726 and chamber 728 may be open, with the portion of the e-textile connector 710 extending into such area of the holder 720 for mating with the mating connector 712. The holder 720 has a relatively low profile such that the connector system 700 remains close to the wearable article 100.

Figure 3:
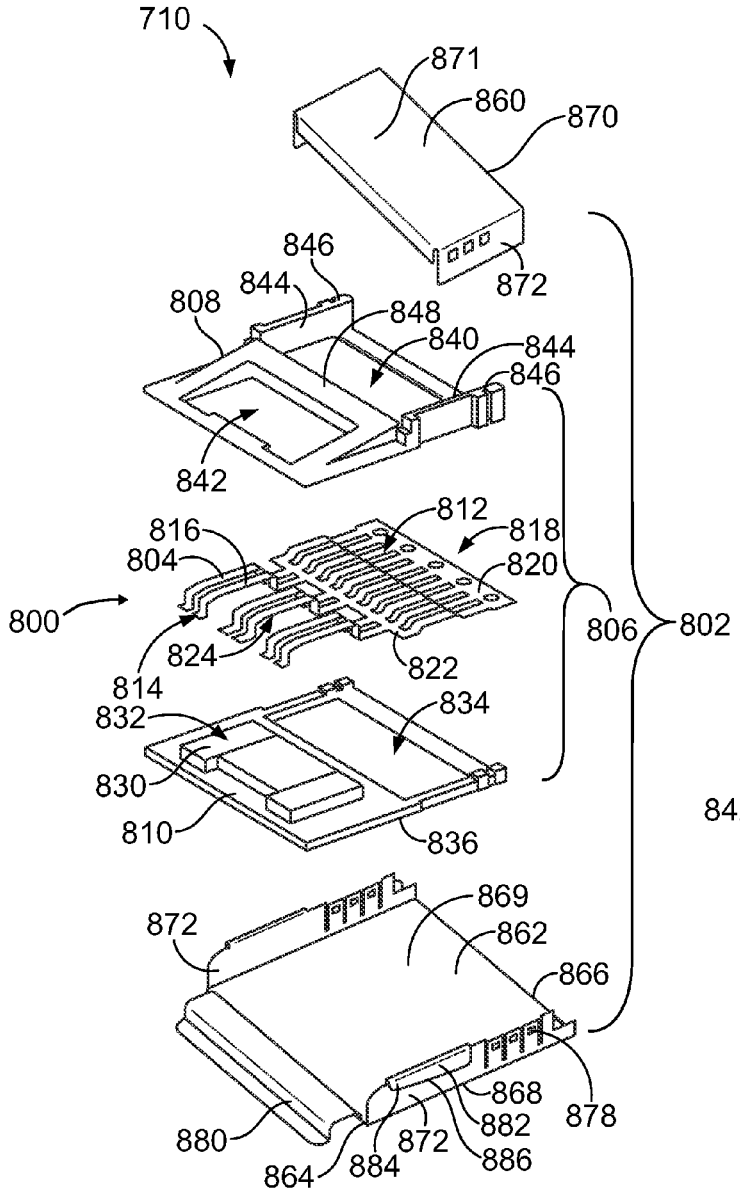
FIG. 3 is an exploded view of the e-textile connector shown in FIG. 2.

FIG. 3 is an exploded view of the e-textile connector 710. The e-textile connector 710 includes a terminal subassembly 800 and a shell 802 that holds the terminal subassembly 800. The shell 802 is manufactured from a conductive material such that the shell 802 provides shielding for the terminal subassembly 800. The terminal subassembly 800 may provide impedance control for the connector 710.

The terminal subassembly 800 has a plurality of terminals 804 that are configured to be electrically connected to corresponding conductors 705 (shown in FIG. 2) of the e-textile layer 702 (shown in FIG. 2). The terminal subassembly 800 has an insulator 806 that holds the terminals 804. The insulator 806 electrically isolates the terminals 804 from the shell 802 and may provide impedance control, such as by positioning the terminals 804 at predetermined locations to achieve a target characteristic impedance. In the illustrated embodiment, the insulator 806 is manufactured from multiple pieces, namely an upper insulator 808 and a lower insulator 810. The upper and lower insulators 808, 810 are secured together to capture the terminals 804 therebetween. Optionally, the upper and lower insulators 808, 810 may be bonded together. In an alternative embodiment, the insulator 806 may be overmolded over the terminals 804 as a one piece insulator.

The terminals 804 have terminating ends 812 and mating ends 814. The mating ends 814 have mating interfaces 816 configured for mating with the mating connector 712 (shown in FIG. 2). The terminating ends 812 are configured to be electrically connected to corresponding conductors 705 of the e-textile layer 702. In an exemplary embodiment, the terminating ends 812 are configured to be ultrasonically welded to the conductors 705. Alternatively, the terminating ends 812 may be terminated to the conductors 705 in a different manner, such as by soldering, crimping, or by other means.

Optionally, the terminating ends 812 may be compression crimped to the conductors 705. The terminating ends 812 may be electrically connected to the conductors 705 by the compression crimping method or the ultrasonic welding method as described in Provisional Application Ser. No. 61/384,593 filed Sep. 20, 2010, titled "INTERCONNECT OR TERMINATION METHODOLOGY FOR E-TEXTILES", the complete subject matter of which is hereby expressly incorporated by reference in its entirety.

In an exemplary embodiment, the terminals 804 are manufactured as part of a lead frame 818 wherein each of the terminals 804 are stamped and formed from a common blank and held together by a carrier 820, which is later removed to separate the terminals 804. Optionally, the lead frame 818 may be a programmable lead frame, in which selected terminals 804 may be ganged together to perform a common function, such as to transmit power or data along each of the ganged terminals 804. Different sets of terminals 804 may be ganged together in different embodiments depending on the particular application. For example, the lead frame 818 is manufactured with connecting segments 822 between each of the terminals 804 such that all of the terminals 804 are initially connected together. Any of the connecting segments 822 may be removed, such as by cutting the connecting segment, to separate the adjacent terminals 804 from one another. Depending on which connecting segments 822 are removed, the terminals 804 may cooperate with one another to perform a common function. The mating ends 814 of the terminals 804 have raised sections 824 that extend out of plane with respect to other portions of the terminals 804. The raised sections 824 extend over a terminal backer 830 of the lower insulator 810. The raised sections 824 and terminal backer 830 have similar profiles such that the terminals 804 closely follow the terminal backer 830.

The terminal backer 830 supports the mating ends 814 of the terminals 804. The terminal backer 830 is a raised block that provides a surface for the terminals 804 to rest on. Optionally, the terminal backer 830 may include grooves 832 that receive corresponding terminals 804. When the terminals 804 are received in the grooves 832, the exposed surfaces of the terminals 804 may be flush with the top of the terminal backer 830, which may provide a wipeable or cleanable surface for cleaning the terminals 804.

The lower insulator 810 includes a terminating window 834. The terminating window 834 extends entirely through the lower insulator 810. The terminating window 834 is positioned behind the terminal backer 830. When the terminals 804 are held by the insulator 806, the terminating ends 812 of the terminals 804 are exposed by the terminating windows 834. The lower insulator 810 has a bottom 836 that defines a bottom of the insulator 806.

The upper insulator 808 has a terminating window 840 and a mating window 842 positioned forward of the terminating window 840. When the terminal subassembly 800 is assembled, the mating interfaces 816 of the terminals 804 are exposed in the mating window 842 and the terminating ends 812 of the terminals 804 are exposed in the terminating window 840. The terminating ends 812 of the terminals 804 are terminated to the e-textile conductors 705 within the terminating windows 834 and 840.

The upper insulator 808 has side walls 844 positioned on opposite sides of the terminating window 840. The side walls 844 have tops 846 that define a top of the insulator 806. The upper insulator 808 has an intermediate wall 848 extending between the terminating window 840 and the mating window 842. The intermediate wall 848 engages the leadframe 818 to hold the terminals 804 within the insulator 806. Optionally, portions of the leadframe 818 may be captured between the intermediate wall 848 and the terminal backer 830. Portions of the leadframe 818 may be captured between the intermediate wall 848 and the lower insulator 810.

The shell 802 includes an upper shell 860 and a lower shell 862. The upper and lower shells 860, 862 are coupled together to form the shell 802. The shell 802 provides shielding for the terminal subassembly 800. The shell 802 includes a front 864, a rear 866, a bottom 868 and a top 870. A top wall 871 defines the top 870. A bottom wall 869 defines the bottom 868. The shell 802 include side walls 872 extending between the front 864 and the rear 866 and extending between the top 870 and the bottom 868. In the illustrated embodiment, the upper shell 860 defines the top 870 of the shell 802 and includes portions of the side walls 872. The lower shell 862 defines the bottom 868 of the shell 802 and defines portions of the side walls 872. The lower shell 862 extends from the front 864 to the rear 866. The upper shell 860 extends only partially between the front and the rear 864, 866. In an exemplary embodiment, the upper shell 860 is provided at the rear 866 shielding the terminating window 840 of the terminal subassembly 800, such that the shell 802 has an open top at the front 864 leaving the mating window 842 of the terminal subassembly 800 open.

When assembled, the shell 802 forms a cavity 874 (shown in FIG. 6) that receives the terminated terminal subassembly 800. The cavity 874 extends along a cavity axis 876 (shown in FIG. 6) between the front 864 and the rear 866. The terminal subassembly 800 is received in the cavity 874 such that the terminals 804 generally extend along the cavity axis 876.

The shell 802 is open at the front 864 and the rear 866. The shell 802 is configured to receive a portion of the mating connector 712 through the front 864. The shell 802 is configured to receive the e-textile layer 702 (shown in FIG. 2) through the rear 866.

The terminal subassembly 800 is received in the cavity 874 such that the mating interfaces 816 of the terminals 804 are provided proximate to the front 864 and the terminating ends 812 of the terminals 804 are provided proximate to the rear 866. Tabs or other locating features may be provided on the terminal subassembly 800 and/or the shell 802 to locate the terminal subassembly 800 in the shell 802. The bottom 836 of the insulator 806 rests on the bottom 868 of the shell 802. The mating window 842 is aligned with the open portion of the top 870 of the shell 802. As such, the mating interfaces 816 of the terminals 804 are exposed through the open top of the shell 802. The upper shell 860 extends across the top 846 of the terminal subassembly 800. The upper shell 860 is aligned with the side walls 844 and extends between the side walls 844 across the terminating windows 840.

The lower shell 862 includes tabs 878 proximate to the rear 866 that engage the upper shell 860 to couple the upper shell 860 to the lower shell 862. The side walls 872 of the upper shell 860 extend along and overlap the side walls 872 of the lower shell 862.

In an exemplary embodiment, the lower shell 862 includes a mounting tab 880 at the front 864. The mounting tab 880 is used to secure the shell 802 to the holder 720 (shown in FIG. 2). For example, the mounting tab 880 may be received in a pocket in the holder 720 or a pocket formed between the holder 720 and the fabric layer 704.

The lower shell 862 includes securing features 882 extending from the side wall 872 for securing the mating connector 712 to the e-textile connector 710. In the illustrated embodiment, the securing features 882 include ramps 884 that have sloped surfaces 886. The sloped surfaces 886 are downward facing such that the sloped surfaces 886 face the bottom 868. In an exemplary embodiment, the ramps 884 are formed by folding over a portion of the side walls 872 at the top 870 along the exterior of the side walls 872. The edges of the ramps 884 define the sloped surfaces 886. In an exemplary embodiment, the sloped surfaces 886 are non-parallel to the top 870. The sloped surface 886 defines a cam profile that is configured to be engaged by the mating connector 712 during mating of the e-textile connector 710 and the mating connector 712. The ramps 884 are oriented such that the sloped surfaces 886 are closer to the top 870 at the front of the ramps 884 and further from the top 870 at a rear of the ramp 884. The sloped surfaces 886 may follow a nonlinear path between the front and the rear of the ramps 884.

Figure 4:
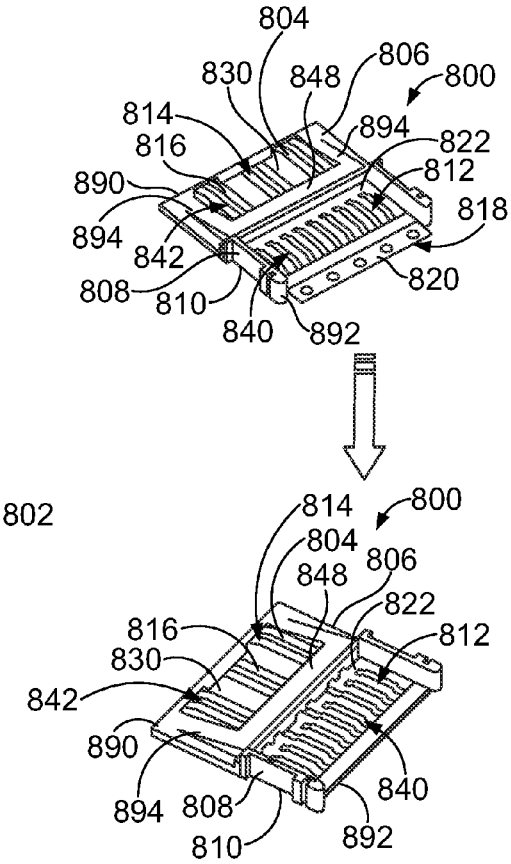
FIG. 4 is a rear perspective view of a terminal subassembly for the e-textile connector during various stages of manufacture.

FIG. 4 is a rear perspective view of the terminal subassembly 800 during various stages of manufacture. During one stage of manufacture (shown at the left of FIG. 4), the terminal subassembly 800 is assembled such that the lead frame 818 is captured between the upper and lower insulators 808, 810. The carrier 820 is still coupled to the terminals 804 in such stage of manufacture.

During manufacture, the carrier 820 is removed as well as one or more of the connecting segments 822. For example, the terminal subassembly 800 is shown in a second stage of manufacture (shown at the bottom in FIG. 4), in which the carrier 820 and a plurality of the connecting segments 822 have been removed.

In the illustrated embodiment, the leadframe 818 provides ten terminating ends 812 and six mating ends 814. Multiple terminals 804 are ganged together to provide the different number of mating interfaces 816 than at the terminating ends 812. For example, three terminals may be combined into two terminals or two terminals may be combined into one terminal, or other combinations are possible in alternative embodiments. Ganging is achieved by removing or not removing connecting segments 822

The terminal subassembly 800 includes a front 890 and a rear 892. The mating ends 814 of the terminals 804 are provided proximate to the front 890. The terminating ends 812 of the terminals 804 are provided proximate to the rear 892. The mating window 842 is provided proximate to the front 890. The terminating window 840 is provided proximate to the rear 892.

In an exemplary embodiment, the insulator 806 has a mating face 894 surrounding mating windows 842. The mating face 894 defines the seal interface for the insulator 806 when mated with the mating connector 712 (shown in FIG. 2). In an exemplary embodiment, the mating face 894 is angled such that the mating face 894 is forward and upward facing. Optionally, the mating face 894 may be angled at approximately a 10° angle. The insulator 806 is thinner proximate the front 890 and thicker proximate the rear 892. The mating face 894 is angled between the front 890 and the rear 892. Optionally, the mating face 894 may be angled between the front 890 and the intermediate wall 848. The angled mating face 894 may enhance the mechanical durability of the connector 710, such as by increasing the number of mating cycles, because the sealing engagement is more in compression than shear.

In an exemplary embodiment, a portion of the terminal backer 830 and the terminals 804 extend through the mating window 842. The mating face 894 is angled such that the forward portion of the mating face 894 is positioned below the mating interfaces 816 of the terminals 804 and the rear portion of the mating face 894 is positioned above the mating interfaces 816 of the terminals 804. The terminal backer 830 and terminals 804 define a wipeable or cleanable surface because they are exposed through the mating window 842. For example, a user may use their thumb or a cloth to wipe across the mating face 894 to clear debris or dirt from the terminals 804.

Figure 5:
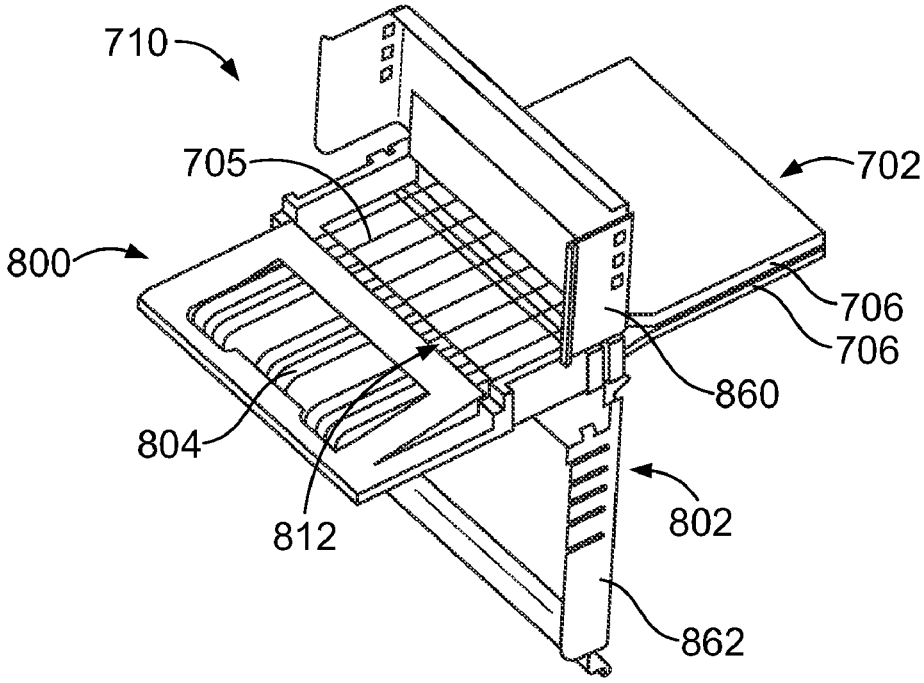
FIG. 5 shows the e-textile connector during another stage of manufacture.

FIG. 5 shows the e-textile connector 710 during another stage of manufacture in which the e-textile layer 702 is being terminated to the e-textile connector 710. During assembly, the e-textile layer 702 is aligned with the rear of the e-textile connector 710. The conductive layer is placed on the terminating ends 812 of the terminals 804 such that the conductors 712 may be terminated to the terminating end 812 of the terminals 804. For example, the conductors 705 may be ultrasonically welded to the terminals 804, or the conductors 705 may be terminated by other means, such as a compressive crimped, soldering, and the like as known in the industry. In an exemplary embodiment, the e-textile layer 702 includes an insulator layer 706 surrounding the conductors 705. The insulator layer 706 is positioned between and/or around the conductors 705. Once the e-textiles layers 702 are terminated to the e-textile connectors 710, the upper and lower shells 860, 862 may be coupled together around the terminal subassembly 800.

Figure 6:
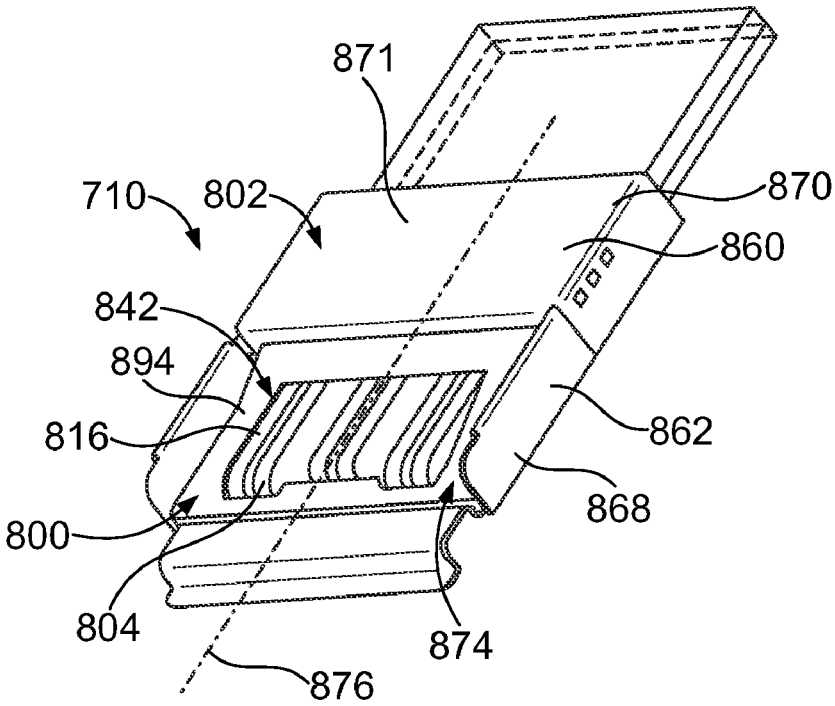
FIG. 6 illustrates the e-textile connector in an assembled state.

FIG. 6 illustrates the e-textile connector 710 in an assembled state. The upper shell 860 is coupled to the lower shell 862. The terminal subassembly 800 extends forward of the upper shell 860 and is exposed through the open top of the shell 802, which is the portion of the shell 802 forward of the upper shell 860. The terminal subassembly 800 is received in the cavity 874 and extends generally along the cavity axis 876. The mating face 894 is angled with respect to the top 870 and the bottom 868 of the shell 802 such that the mating face 894 is forward and upward facing. The mating window 842 is angled transverse to the cavity axis 876 to expose the terminals 804. The mating window 842 is angled with respect to the terminal 804 such that a front portion of the mating window 842 is positioned below the mating interfaces 816 of the terminal 804 and a rear portion of the mating window 842 is positioned above the mating interfaces 816 of the terminal 804.

The terminal subassembly 800 is arranged within the shell 802 such that the top wall 871 of the shell 802 extends along and shields the terminating window 840 (shown in FIG. 3) and such that the bottom wall 869 of the shell 802 extends along and shields the terminating window 834 (shown in FIG. 3) and the mating window 842.

Figure 7:
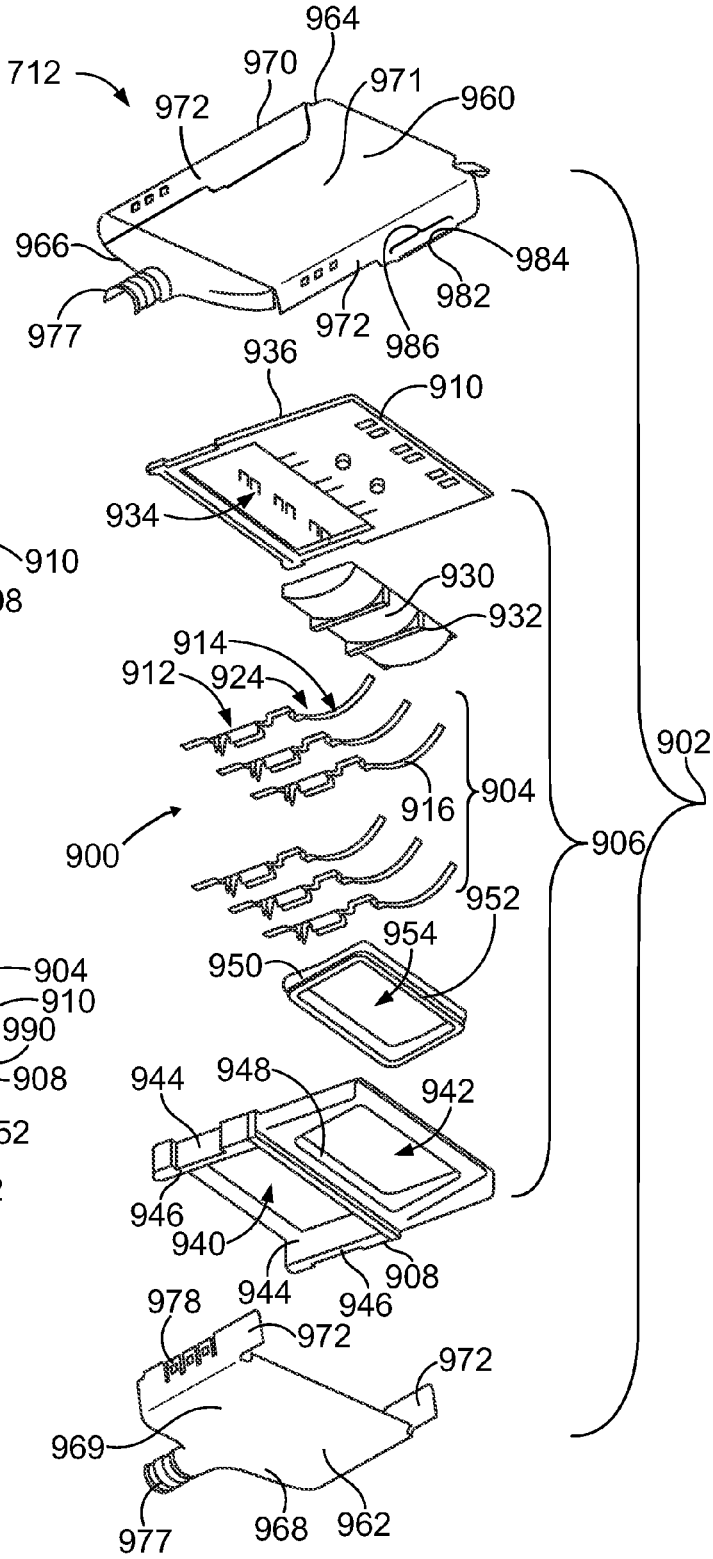
FIG. 7 is an exploded view of the mating connector shown in FIG. 2.

FIG. 7 is an exploded view of the mating connector 712. In the illustrated embodiment, the mating connector 712 is configured to be cable mounted as part of the jumper assembly 714 (shown in FIG. 2), however, it is realized that the mating connector 712 may be an integral part of the electronic device 716 (shown in FIG. 2), such as a header connector extending from the electronic device 716, which may be plugged directly into the mating connector 712 (shown in FIG. 2). Alternatively, the mating connector 712 may be imbedded directly into the electronic device 716, where the electronic device 716 itself would mate to the mating e-textile connector 710.

The mating connector 712 includes a terminal subassembly 900 and a shell 902 that holds the terminal subassembly 900. The shell 902 is manufactured from a conductive material such that the shell 902 provides shielding for the terminal subassembly 900.

The terminal subassembly 900 has a plurality of terminals 904 that are configured to be electrically connected to corresponding wires of the cable 718 (shown in FIG. 2). The terminal subassembly 900 has an insulator 906 that holds the terminals 904. The insulator 906 electrically isolates the terminals 904 from the shell 902. In the illustrated embodiment, the insulator 906 is manufactured from multiple pieces, namely a lower insulator 908 and an upper insulator 910. The lower and upper insulators 908, 910 are secured together to capture the terminals 904 therebetween. Optionally, the lower and upper insulators 908, 910 may be bonded, welded or otherwise secured together. In an alternative embodiment, the insulator 906 may be overmolded over the terminals 904 as a one piece insulator.

The terminals 904 have terminating ends 912 and mating ends 914. The mating ends 914 have mating interfaces 916 configured for mating with the mating interfaces 816 of the terminals 804 of the e-textile connector 710 (both shown in FIG. 3). The terminating ends 912 are configured to be electrically connected to corresponding wires of the cable 718. In an exemplary embodiment, the terminating ends 912 have insulation displacement contacts for making electrical connection with the wires. Alternatively, the terminating ends 912 may be terminated to the wires in a different manner, such as by soldering, crimping, or by other means known in the industry. Alternatively, the terminating ends 912 may be surface mount or through hole leads that are soldered to a printed circuit board (PCB) that is integral to the electronic device 716

Optionally, the terminals 904 may be manufactured as part of a lead frame, wherein each of the terminals 904 are stamped and formed from a common blank and held together by a carrier (not shown), which is later removed to separate the terminals 904. The mating ends 914 of the terminals 904 have raised sections 924 that extend out of plane with respect to other portions of the terminals 904. The raised sections 924 extend over a terminal backer 930 of the upper insulator 910. The raised sections 924 and terminal backer 930 have similar profiles such that the terminals 904 closely follow the terminal backer 930. Optionally, the raised sections 924 may define contact springs that are configured to be deflected during mating with the terminals 804 to impart a spring force against the terminals 804.

The terminal backer 930 supports the mating interfaces 916 of the terminals 904. In the illustrated embodiment, the terminal backer 930 is separately provided from, and configured to be coupled to, the upper insulator 910. Alternatively, the terminal backer 930 may be integrally formed with the upper insulator 910. The terminal backer 930 is a raised block that provides a surface for the mating interfaces 916 of the terminals 904 to rest on as a mechanical support. The terminal backer 930 keeps debris from getting under and building up behind the terminals 904. The terminal backer 930 closes off the mating interface making the mating interface wipeable. Optionally, the terminal backer 930 may include shoulders or ribs 932 that extend upward from the terminal backer 930. When the mating interfaces 916 are received in the spaces between the ribs 932, the mating interfaces 916 may be slightly recessed to protect the mating interfaces 916 from damage. The mating interfaces 916 are exposed to provide a wipeable or cleanable surface for cleaning the terminals 904.

The upper insulator 910 includes a terminating window 934. The terminating window 934 extends entirely through the upper insulator 910. The terminating window 934 is positioned behind the terminal backer 930. When the terminals 904 are held by the insulator 906, the terminating ends 912 of the terminals 904 are exposed by the terminating windows 934. The upper insulator 910 has a top 936 that defines a top of the insulator 906.

The lower insulator 908 has a terminating window 940 and a mating window 942 positioned forward of the terminating window 940. When the terminal subassembly 900 is assembled, the mating interfaces 916 of the terminals 904 are exposed in the mating window 942 and the terminating ends 912 of the terminals 904 are exposed in the terminating window 940. The terminals 904 are terminated to the conductors 705 within the terminating window 940.

The lower insulator 908 has side walls 944 positioned on opposite sides of the terminating window 940. The side walls 944 have bottoms 946 that define a bottom of the insulator 906. The lower insulator 908 has an intermediate wall 948 extending between the terminating window 940 and the mating window 942. The intermediate wall 948 engages the terminals 904 to hold the terminals 904 within the insulator 906. Optionally, portions of the terminals 904 may be captured between the intermediate wall 948 and the terminal backer 930. Portions of the terminals 904 may be captured between the intermediate wall 948 and the upper insulator 910.

The terminal subassembly 900 has a seal 950 that is captured between the lower and upper insulators 908, 910. A portion of the seal 950 extends through the mating window 942. The seal 950 is configured to be held between the lower and upper insulators 908, 910 at an angle. The seal 950 extends around the perimeter of the mating window 942. The seal 950 includes a sealing interface 952 for sealing engagement with the mating face 894 of the insulator 806 (shown in FIG. 3) of the e-textile connector 710. The seal 950 may provide a watertight or water resistant seal to protect against moisture or weather at the interface. In an exemplary embodiment, the seal 950 is manufactured from a silicon material, however the seal 950 may be manufactured from other materials in alternative embodiments. The seal 950 has an opening 954 therethrough. The mating interfaces 916 are exposed through the opening 954.

The shell 902 includes an upper shell 960 and a lower shell 962. The upper and lower shells 960, 962 are coupled together to form the shell 902. The shell 902 provides shielding for the terminal subassembly 900. The shell 902 includes a front 964, a rear 966, a bottom 968 and a top 970. A top wall 971 defines the top 970. A bottom wall 969 defines the bottom 968. The shell 902 include side walls 972 extending between the front 964 and the rear 966 and extending between the top 970 and the bottom 968. In the illustrated embodiment, the upper shell 960 defines the top 970 of the shell 902 and includes portions of the side walls 972. The lower shell 962 defines the bottom 968 of the shell 902 and defines portions of the side walls 972. The upper shell 960 extends from the front 964 to the rear 966. The lower shell 962 extends only partially between the front and the rear 964, 966. In an exemplary embodiment, the lower shell 962 is provided at the rear 966 such that the shell 902 has an open bottom at the front 964.

When assembled, the shell 902 forms a cavity 974 (shown in FIG. 9) that receives the terminal subassembly 900. Tabs or other locating features may be provided on the terminal subassembly 900 and/or the shell 902 to locate the terminal subassembly 900 in the shell 902. The cavity 974 extends along a cavity axis 976 (shown in FIG. 9) between the front 964 and the rear 966. The terminal subassembly 900 is received in the cavity 974 such that the terminals 904 generally extend along the cavity axis 976.

The shell 902 is open at the front 964 and includes a cable boss 977 at the rear 966. The shell 902 is configured to receive a portion of the e-textile connector 710 through the front 964. The shell 902 is configured to receive the wires of the cable 718 through the cable boss 977 at the rear 966. The cable boss 977 is configured to be secured to the braid shield or a drain wire within the cable 718, such as using a cable clamp, ferrule, boot or other means known in the industry.

The terminal subassembly 900 is received in the cavity 974 such that the mating ends 914 of the terminals 904 are provided proximate to the front 964 and the terminating ends 912 of the terminals 904 are provided proximate to the rear 966. The top 936 of the insulator 906 rests against the top 970 of the shell 902, which shields both the terminating window 934 and the mating window 942 of the terminal subassembly 900. The bottom 946 of the insulator 908 rests against the bottom 968 of the shell 902, which shields the terminating window 934 of the terminal subassembly 900 and/or leaves the mating interface 916 of the terminal subassembly 900 exposed. The mating window 942 is aligned with the open portion of the bottom 968 of the shell 902. As such, the mating interfaces 916 of the terminals 904 are exposed through the open bottom of the shell 902. The upper shell 960 extends across the top 936 of the terminal subassembly 900. The upper and lower shells 960, 962 extend across the terminating windows 934, 940.

The lower shell 962 includes tabs 978 proximate to the rear 966 that engage the upper shell 960 to couple the upper shell 960 to the lower shell 962. The side walls 972 of the upper shell 960 extend along and overlap the side walls 972 of the lower shell 962.

The upper shell 960 includes securing features 982 extending from the side wall 972 for securing the mating connector 712 to the e-textile connector 710. In the illustrated embodiment, the securing features 982 include ramps 984 that have sloped surfaces 986. The surfaces 986 define a follower that engages the ramp 884 (shown in FIG. 3) to secure the shell 960 to the shell 860 (shown in FIG. 3). The sloped surfaces 986 are upward facing such that the sloped surfaces 986 face the top 970. In an exemplary embodiment, the ramps 984 are formed by folding over (e.g. inward) a portion of the side walls 972 at the top 970 along the interior of the side walls 972. The edges of the ramps 984 define the sloped surfaces 986. In an exemplary embodiment, the sloped surfaces 986 are non-parallel to the top 970. The sloped surface 986 defines a cam profile that is configured to be engaged by the corresponding ramp 884 (shown in FIG. 3) of the e-textile connector 710 during mating of the mating connector 712 and the e-textile connector 710. The ramps 984 are oriented such that the sloped surfaces 986 are closer to the top 970 at the front of the ramps 984 and further from the top 970 at a rear of the ramp 984. The sloped surfaces 986 may follow a nonlinear path between the front and the rear of the ramps 984.

Figure 8:
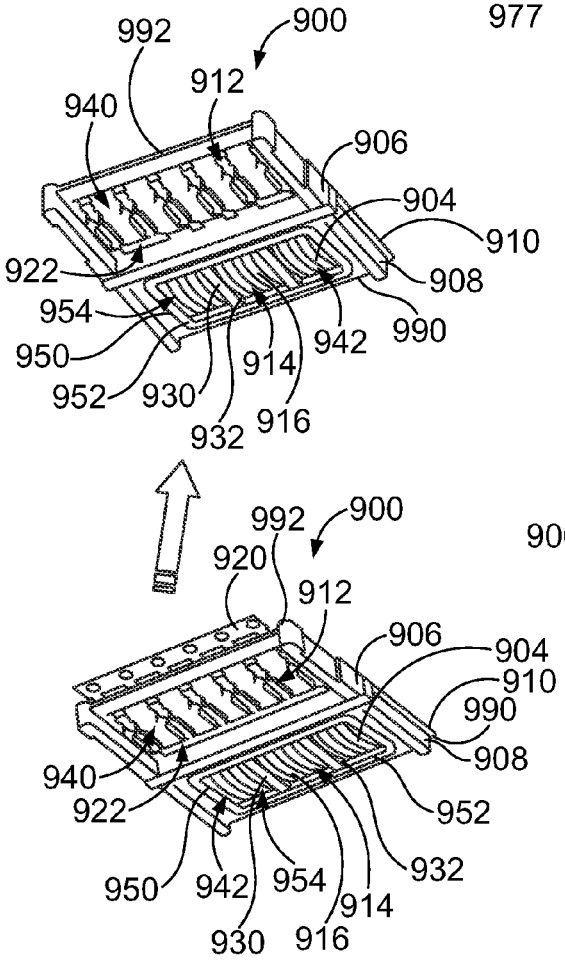
FIG. 8 is a bottom, front perspective view of a terminal subassembly for the mating connector during various stages of manufacture.

FIG. 8 is a bottom, rear perspective view of the terminal subassembly 900 during various stages of manufacture. During one stage of manufacture (shown at the top of FIG. 8), the terminal subassembly 900 is assembled such that the terminals 904 are held together as a lead frame that is captured between the lower and upper insulators 908, 910. A carrier 920 holds the terminals 904 as part of the lead frame.

During manufacture, the carrier 920 is removed as well as one or more connecting segments 922 between the terminals 904. For example, the terminal subassembly 900 is shown in a second stage of manufacture (shown at the left in FIG. 8), in which the carrier 920 and a plurality of the connecting segments 922 have been removed. In the illustrated embodiment, the outermost pairs of terminals 904 are ganged together, while the inner terminals 904 are separated from one another and from the outermost pairs of terminals 904.

The terminal subassembly 900 includes a front 990 and a rear 992. The mating ends 914 of the terminals 904 are provided proximate to the front 990. The terminating ends 912 of the terminals 904 are provided proximate to the rear 992. The mating window 942 is provided proximate to the front 990. The terminating window 940 is provided proximate to the rear 992.

In an exemplary embodiment, the sealing interface 952 of the seal 950 surrounds the mating window 942. The sealing interface 952 defines a seal for the insulator 906 when mated with the mating face 894 of the e-textile connector 710. In an exemplary embodiment, the sealing interface 952 is angled such that the sealing interface 952 is forward and downward facing. Optionally, the sealing interface 952 may be angled at approximately a 10° angle. The insulator 906 is thinner proximate the front 990 and thicker proximate the rear 992.

In an exemplary embodiment, a portion of the terminal backer 930 and the terminals 904 extend through the mating window 942 and the opening 954 in the seal 950. The sealing interface 952 is angled such that the forward portion of the sealing interface 952 is positioned above the mating interfaces 916 of the terminals 904 and the rear portion of the sealing interface 952 is positioned below the mating interfaces 916 of the terminals 904. The terminal backer 930 and terminals 904 define a wipeable or cleanable surface because they are exposed through the mating window 942 and the opening 954. For example, a user may use their thumb or a cloth to wipe across the terminals 904 to clear debris or dirt from the terminals 904. The ribs 932 protect the terminals 904 during such wiping action.

Figure 9:
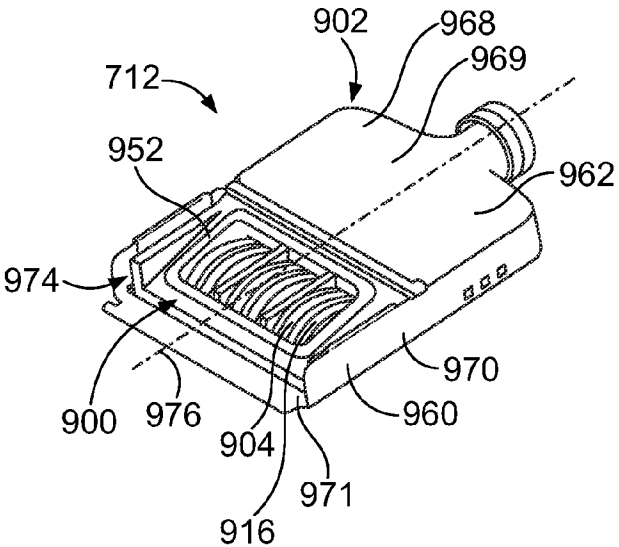
FIG. 9 illustrates the mating connector in an assembled state.

FIG. 9 illustrates the mating connector 712 in an assembled state. The upper shell 960 is coupled to the lower shell 962. The terminal subassembly 900 extends forward of the lower shell 962 and is exposed through the open bottom of the shell 902, which is the portion of the shell 902 forward of the lower shell 962. The terminal subassembly 900 is received in the cavity 974 and extends generally along the cavity axis 976. The sealing interface 952 is angled with respect to the top 970 and the bottom 968 of the shell 902 such that the sealing interface 952 is forward and downward facing. The mating window 942 is angled transverse to the cavity axis 976 to expose the terminals 904. The mating window 942 is angled with respect to the terminal 904 such that a front portion of the mating window 942 is positioned above the mating interfaces 916 of the terminal 904 and a rear portion of the mating window 942 is positioned below the mating interfaces 916 of the terminal 904.

The terminal subassembly 900 is arranged within the shell 902 such that the bottom wall 969 of the shell 902 extends along and shields the terminating window 934 (shown in FIG. 7) and such that the top wall 971 of the shell 902 extends along and shields the terminating window 940 (shown in FIG. 7) and the mating window 942.

Figure 10:
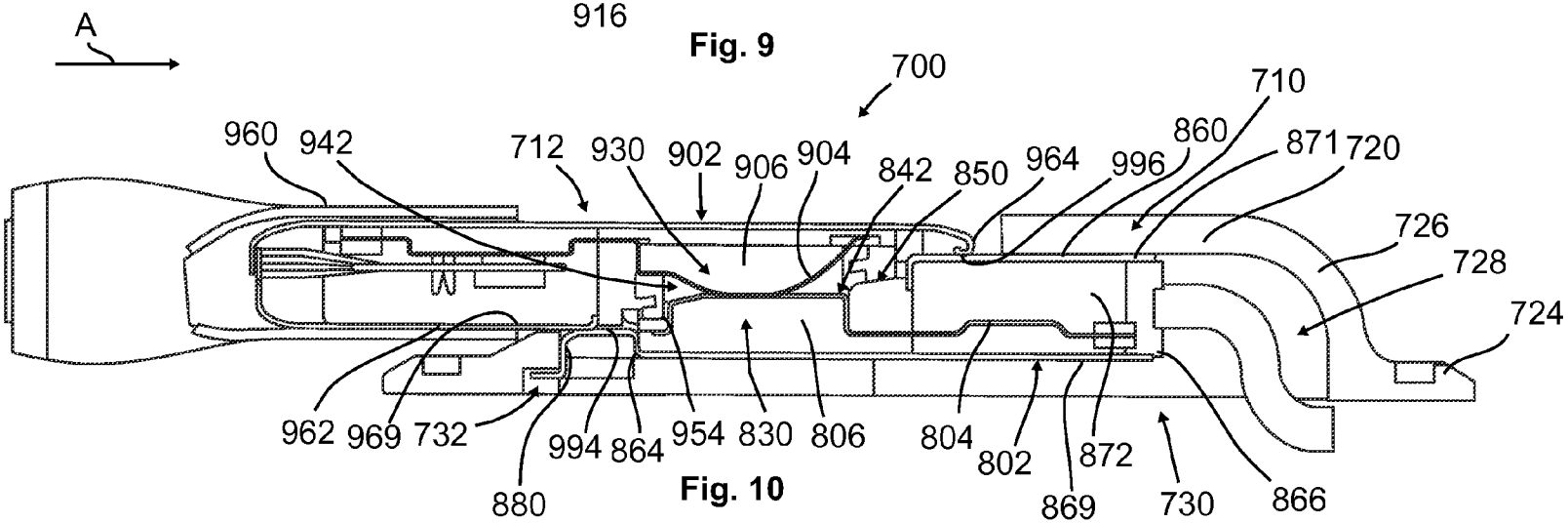
FIG. 10 is a cross-sectional view of the connector system showing the mating connector mated with the e-textile connector.

FIG. 10 is a cross-sectional view of the connector system 700 showing the mating connector 712 mated with the e-textile connector 710. When assembled, the e-textile connector 710 is held in the holder 720. Optionally, the e-textile connector 710 may be loaded into the holder 720 through the opening 730 in the base 724 from inside the wearable article 100 (shown in FIG. 1), such as thorough a button hole or dedicated opening in the outer fabric layer of the wearable article 100. The e-textile connector 710 is held by the holder 720 such that the open top of the e-textile connector 710 is exposed and configured for mating with the mating connector 712. Having the open top of the e-textile connector 710, and thus the terminals 804, exposed allows the terminals 804 to be wiped clean prior to mating with the mating connector 712, such as with the wearer's thumb or a cloth.

The e-textile connector 710 is held in the chamber 728. In an exemplary embodiment, the mounting tab 880 is received in a channel 732 to secure the front 864 of the shell 802, and the rear 866 of the shell 802 is held by the shroud 726. Other securing means or features may be used in alternative embodiments to hold the e-textile connector 710 in position with respect to the holder 720.

The mating face 894 (shown in FIG. 4) of the insulator 806 is exposed through the open top of the shell 802. The mating face 894 is angled for ease of mating with the mating connector 712. The angled mating face 894 exposes the terminals 804 for mating with the terminals 904 of the mating connector 712. For example, the mating connector 712 may be mated in a mating direction that is generally parallel to the base 724 of the holder 720, shown by the arrow A. The securing features 882 (shown in FIG. 3) of the e-textile connector 710 engage the securing features 982 (shown in FIG. 7) of the mating connector 712 to draw the terminals 804, 904 into engagement and to draw the sealing interface 952 (shown in FIG. 7) into the mating face 894 to seal the insulators 806, 906 around the mating windows 842, 942. The sealing engagement between the sealing interface 952 and the mating face 894 is in both compression and shear when the mating connector 712 is fully mated because the mating connector 712 wipes across the e-textile connector 710 as the mating connector 712 is drawn down into the e-textile connector 710. The sloped surfaces 986, 886 draw the mating connector 712 into the e-textile connector 710 as the mating connector 712 is moved along the mating direction (e.g. the mating connector 712 is moved forward and downward by the interaction of the sloped surfaces 886, 986 (shown in FIGS. 3 and 7, respectively).

The terminals 804 and/or 904 may be at least partially deflected during mating forcing the terminals 804, 904 to be spring biased against one another. The terminal backer 930 may be partially compressed during mating forcing the terminals 804, 904 into one another to maintain electrical contact therebetween. The seal 950 may be partially compressed during mating to the mating face 894 ensuring a uniform, sealed surface around the mating windows 842, 942.

In an exemplary embodiment, when the e-textile connector 710 and mating connector 712 are coupled together, the shells 802, 902 engage one another to maintain electrical continuity therebetween. The shells 802, 902 may be electrically grounded. The shell 802 includes a shield finger 994 that engages the shell 902. In the illustrated embodiment, the shield finger 994 is part of the mounting tab 880. The shield finger 994 engages the bottom wall 969 of the lower shell 962. The shield finger 994 may be at least partially deflected when engaging the shell 902 to maintain a biasing force against the bottom wall 969. The shell 902 includes a shield finger 996 that engages the shell 802. In the illustrated embodiment, the shield finger 996 extends forward from the front 964 of the upper shell 960 to engage the top wall 871 of the upper shell 860. The shield finger 996 is at least partially deflected when engaging the shell 802 to maintain a biasing force against the top wall 871.

In an exemplary embodiment, the shells 802, 902 cooperate to provide 360° shielding around the terminals 804, 904. For example, the shell 902 covers the open top of the shell 802, while the shell 802 covers the open bottom of the shell 902. The sidewalls 872, 972 (shown in FIGS. 3 and 7, respectively) overlap one another and engage one another to provide shielding and an electrical path therebetween. The electrical shielding prevents possible EMI/RFI on the signal paths defined through the e-textile connector 710 and mating connector 712. The electrical shielding allows high speed data to be uninterrupted by the connector system 700.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector for an e-textile having conductors defining a conductive layer of the e-textile, the connector comprising:

a terminal subassembly having terminals electrically connected to corresponding conductors of the e-textile, the terminal subassembly having an insulator holding the terminals, the terminals having mating interfaces; and a shell holding the terminal subassembly, the shell having a front and a rear, the rear being configured to receive the e-textile, the shell having a bottom and a top, the top being open sided to provide access to the mating interfaces of the terminals for mating with a mating connector.

2. The connector of claim 1, wherein the insulator has a mating window proximate to a front of the terminal subassembly and a terminating window proximate to a rear of the terminal subassembly, the mating window being exposed through the open sided portion of the top of the shell, the terminals being exposed in the mating window and in the terminating window, terminating ends of the terminals configured to be electrically connected to corresponding conductors of the e-textile in the terminating window, mating ends of the terminals being exposed in the mating window for mating with a mating connector.

3. The connector of claim 1, wherein the insulator has a mating face for mating with the mating connector, the mating face being angled with respect to the top and the bottom of the shell such that the mating face is forward and upward facing.

4. The connector of claim 1, wherein the mating face defines a seal configured to engage a seal of the mating connector, the sealing engagement being in both compression and shear when the mating connector is fully mated.

5. The connector of claim 1, wherein the insulator includes an upper insulator and a lower insulator separately provided from and coupled to the upper insulator, portions of the terminals being sandwiched between the upper and lower insulators.

6. The connector of claim 1, wherein the insulator includes a terminal backer, the terminals resting on the terminal backer such that the mating interfaces are exposed above the terminal backer.

7. The connector of claim 1, wherein the shell includes side walls extending between the front and the rear and extending between the top and the bottom, the side walls having a ramp with a sloped surface, the ramp being configured to drive the mating connector into engagement with the terminal subassembly during mating with the mating connector.

8. The connector of claim 1, wherein the shell has a cavity extending along a cavity axis, the terminal subassembly received in the cavity such that the terminals generally extend along the cavity axis, the insulator having a mating face being angled transverse to the cavity axis.

9. The connector of claim 1, wherein the shell has a cavity extending along a cavity axis, the terminal subassembly received in the cavity such that the terminals generally extend along the cavity axis, the shell includes a ramp with a sloped surface angled transverse to the cavity axis, the shell being coupled to the mating connector in a direction along the connector axis, the ramp driving the mating connector into engagement with the terminal subassembly as the mating connector is loaded along the ramp.

10. The connector of claim 1, wherein the terminals are positioned at predetermined locations to achieve a target characteristic impedance for the connector.

11. A connector for an e-textile having conductors defining a conductive layer of the e-textile, the connector comprising:

a shell defining a cavity extending along a cavity axis between a front and a rear of the shell, the cavity being defined by a bottom wall, a top wall and side walls that provide electrical shielding for the cavity, the top wall being shorter than the bottom wall such that the shell has an open top at the front of the shell; and a terminal subassembly received in the cavity, the terminal subassembly having a plurality of terminals held by an insulator, the terminals having mating ends and terminating ends, the insulator having a mating window proximate to a front of the terminal subassembly, the insulator having a terminating window proximate to a rear of the terminal subassembly, the terminals being exposed in the mating window and in the terminating window, the terminating ends of the terminals electrically connected to corresponding conductors of the e-textile in the terminating window, the mating ends of the terminals being exposed in the mating window for mating with a mating connector.

12. The connector of claim 11, wherein the mating window is angled transverse to the cavity axis.

13. The connector of claim 11, wherein the mating window is angled with respect to the terminals such that a front portion of the mating window is positioned below mating interfaces of the terminals and a rear portion of the mating window is positioned above the mating interfaces.

14. The connector of claim 11, wherein the mating window is surrounded by a seal configured to be sealed with a seal of the mating connector.

15. The connector of claim 11, wherein the top wall of the shell extends along and shields the terminating window, the bottom wall of the shell extends along and shields the terminating window and the mating window.

16. The connector of claim 11, wherein the terminals include a first terminal, a second terminal and a third terminal, in a first programmable combination, the first and second terminals are ganged together and transmit a common data or power signal and the third terminal transmits a different data or power signal, and in a second programmable combination, the second and third terminals are ganged together and transmit a common data or power signal and the first terminal transmits a different data or power signal.

17. The connector of claim 11, wherein the plurality of terminals of the programmable leadframe are connected together by removable connecting segments, when the connecting segments remain between the terminals, the terminals are ganged together as a transmitting unit, different transmitting units are defined by removing the connecting segments between the terminals of the different transmitting units.

18. The connector of claim 11, wherein the multiple terminating ends are combined to feed a particular mating end.

19. The connector of claim 11, wherein at least some of the terminals are bifurcated such that at least two terminating ends share a common mating end.

20. A connector system for an e-textile wearable article having conductors defining an e-textile layer and a fabric layer holding the e-textile layer, the connector system comprising:

a holder configured to be secure to an exterior of the fabric layer of the e-textile wearable article, the holder having a base and an opening in the base through which the e-textile layer extends from inside the wearable article; and a connector coupled to the holder, the connector comprising:

a terminal subassembly having terminals electrically connected to corresponding conductors of the e-textile, the terminal subassembly having an insulator holding the terminals, the terminals having mating interfaces; and a shell holding the terminal subassembly, the shell having a front and a rear, the rear being configured to receive the e-textile, the shell having a bottom and a top, the top being open sided to provide access to the mating interfaces of the terminals for mating with a mating connector.

21. The connector system of claim 20, wherein the holder has a shroud extending over a portion of the base to define a chamber between the base and the shroud, the opening being aligned with the shroud, the connector being received in the chamber such that the open sided portion of the shell extends out of the chamber forward of the shroud for mating with the mating connector.

22. The connector system of claim 20, wherein the holder includes a pocket, a portion of the shell being received in the pocket to secure the connector to the holder.

23. A connector system for an e-textile having conductors defining a conductive layer of the e-textile, the connector comprising:

an e-textile connector configured to be terminated to the conductors of the e-textile and a mating connector mated to the e-textile connector;

the e-textile connector comprising a terminal subassembly having terminals electrically connected to corresponding conductors of the e-textile and an insulator holding the terminals, the e-textile connector further comprising a shell holding the terminal subassembly, the shell having a front and a rear, the shell having a bottom and a top, the top being open sided to provide access to the terminals;

the mating connector comprising a mating terminal subassembly having mating terminals connected to corresponding terminals of the e-textile connector and a mating insulator holding the mating terminals, the mating connector further comprising a mating shell holding the mating terminal subassembly, the mating shell having a front and a rear, the mating shell having a bottom and a top that is open sided to provide access to the mating terminals;

the mating connector coupled to the e-textile connector with the open sided portions of the shell and mating shell being aligned such that the terminals and mating terminals are electrically connected.

24. The connector system of claim 23, wherein the shell and the mating shell engage one another and are electrically connected to one another to electrically common the shell and the mating shell, the shell and the mating shell cooperating to provide 360° shielding around the terminals and the mating terminals.

25. The connector system of claim 23, wherein the shell and the mating shell have corresponding cavities that receive the terminal subassembly and mating terminal subassembly, respectively, the cavities extending along cavity axes, the mating connector being coupled to the e-textile connector in a direction generally along the cavity axes, the terminal subassembly and the mating terminal subassembly having mating faces that are angled transverse to the cavity axes.

26. The connector system of claim 23, wherein the terminal subassembly has an angled surface and the mating terminal subassembly has a seal that sealingly engage one another, the seal and surface being angled with respect to a mating direction of the mating connector.

27. The connector system of claim 23, wherein the shell includes a ramp having a sloped surface, the mating shell having a follower that engages and rides along the sloped surface of the ramp during mating of the e-textile connector and the mating connector to drive the mating terminal subassembly into the terminal subassembly during mating.

28. The connector system of claim 23, wherein at least one of the terminals or the mating terminals are deflected during mating of the e-textile connector and the mating connector.

29. The connector system of claim 23, wherein the mating insulator includes an upper insulator and a lower insulator separately provided from and coupled to the upper insulator, the upper insulator having a mating window therethrough with the mating terminals exposed through the mating window, the mating connector having a seal surrounding the mating window, the seal being captured between the upper insulator and the lower insulator.

* * * * *